US008123662B2

(12) United States Patent
Anderson

(10) Patent No.: US 8,123,662 B2
(45) **Date of Patent: *Feb. 28, 2012**

(54) METHOD AND APPARATUS FOR MAGNETICALLY COUPLING INCREMENTAL WEIGHTS TO EXERCISE APPARATUS

(75) Inventor: Karl Anderson, Glendora, CA (US)

(73) Assignees: Ace Specialty, Inc., Rosemead, CA (US); Grace Premier Fitness and Wellness Products, Inc., Vancouver, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/841,946

(22) Filed: Jul. 22, 2010

(65) Prior Publication Data

US 2010/0285937 A1 Nov. 11, 2010

Related U.S. Application Data

(63) Continuation of application No. 11/425,968, filed on Jun. 22, 2006, now Pat. No. 7,780,582.

(51) Int. Cl.
*A63B 21/072* (2006.01)
*A63B 21/075* (2006.01)

(52) U.S. Cl. ..... 482/107; 482/106

(58) Field of Classification Search ..... 482/106, 482/108, 901, 903, 98, 99, 107, 92, 93, 109
See application file for complete search history.

(56) References Cited

U.S. PATENT DOCUMENTS

| | | | |
|---|---|---|---|
| 1,991,520 | A | 2/1935 | Postl |
| 3,320,564 | A | 5/1967 | Sosey et al. |
| 3,606,314 | A | 9/1971 | Popp |
| 4,076,236 | A | 2/1978 | Ionel |
| 4,529,197 | A | 7/1985 | Gogarty |
| 4,566,690 | A | 1/1986 | Schook |
| 4,579,337 | A | 4/1986 | Uyeda |
| 4,661,813 | A | 4/1987 | Mazzamauro et al. |
| 4,768,780 | A | 9/1988 | Hayes |
| 4,893,810 | A | 1/1990 | Lee |
| 4,971,305 | A | 11/1990 | Rennex |
| 5,256,121 | A | 10/1993 | Brotman |
| 5,344,375 | A | 9/1994 | Cooper |
| 5,348,522 | A | 9/1994 | Brotman |
| 5,407,413 | A | 4/1995 | Kupferman |
| 5,628,716 | A | 5/1997 | Brice |

(Continued)

FOREIGN PATENT DOCUMENTS

US WO2007096864 8/2007

OTHER PUBLICATIONS

Co-pending U.S. Appl. No. 12/626,543, filed Nov. 25, 2009.

(Continued)

*Primary Examiner* — Loan Thanh
*Assistant Examiner* — Daniel Roland
(74) *Attorney, Agent, or Firm* — Seldon & Scillieri

(57) ABSTRACT

A dumbbell and incremental weight plate for same comprise a bar that extends generally axially between opposing end regions, a weight plate mass mounted about the bar at each end region, and at least one incremental weight plate mountable on the dumbbell. The weight plate mass and the incremental weight plate have respective magnetic regions that cause the incremental weight plate to be selectively magnetically secured to the weight plate mass or to be magnetically repelled from the weight plate mass to assist the user in removing the incremental weight plate from the dumbbell.

7 Claims, 8 Drawing Sheets

U.S. PATENT DOCUMENTS

| | | | |
|---|---|---|---|
| 5,735,777 | A | 4/1998 | Benoit |
| 6,261,211 | B1 | 7/2001 | Suarez et al. |
| 6,971,974 | B2 | 12/2005 | Bowman et al. |
| 7,137,931 | B2 | 11/2006 | Liu |
| 7,172,536 | B2 | 2/2007 | Liu |
| 2003/0017919 | A1 | 1/2003 | Lanoue |
| 2004/0072662 | A1 | 4/2004 | Landfair |
| 2006/0172872 | A1 | 8/2006 | Nasir |
| 2007/0117692 | A1 | 5/2007 | Towley et al. |
| 2007/0298940 | A1 | 12/2007 | Anderson |

OTHER PUBLICATIONS

Co-pending U.S. Appl. No. 11/425,962, filed Jun. 22, 2006.

METHOD AND APPARATUS FOR MAGNETICALLY COUPLING INCREMENTAL WEIGHTS TO EXERCISE APPARATUS

CLAIM OF PRIORITY

This is a continuation of U.S. application Ser. No. 11/425,968 filed Jun. 22, 2006, now U.S. Pat. No. 7,780,582, the priority of which are claimed and the contents of which are hereby incorporated by reference.

FIELD OF THE INVENTION

This invention pertains to exercise apparatus of the type employing movable weight plates. Examples of such devices are barbells, dumbbells, and cabled devices, such as the popular Universal machine, that utilize adjustable stacks of weight plates to resist the user's exercise movement. The foregoing equipment shall hereinafter be collectively referred to as "weight plate devices", and the term "weight plate device" will be utilized to referred to one or more of them.

There are two fundamental types of dumbbells and barbells: the "fixed weight" type, wherein the weight plates are permanently secured on the ends of a bar, and the "adjustable" type, wherein weight plates are secured on the bar by removable collars that permit the user to add or remove individual weight plates to the bar. The fixed weight type is typically part of a set wherein a plurality of dumb bells (or barbells) provide a range of weights separated, typically, by 5 lb. increments.

Typically, it is desirable to have an easily and quickly mountable and detachable weight plate that can be used to selectively add or subtract incremental weight to a pre-existing weight plate combination or other pre-existing weight-training mass. For simplicity, this easily mountable and detachable weight plate will be referred to as an "incremental" weight plate because (as will become clear) it is used to incrementally vary the weight to be lifted. In some cases, the incremental weight is quite small; e.g. 0.25 to 2.5 lbs. In other cases, it can be greater or smaller. Generally, incremental weights are used to rehabilitate injured muscles and ligaments, wherein small increases/decreases in resistance are needed in the course of rehabilitation exercises. In other cases, small incremental weights are useful where the user is exercising smaller muscle groups, or is older or physically weak, or has reached a "plateau" that is preventing a major increase to the next full increment of lifted poundage.

The use of magnetically mountable incremental weights is known as one means to quickly and conveniently add and subtract such weight. For example. U.S. Pat. No. 5,735,777 describes the use and application of magnetic "adaptive weights" that are removably attached to dumbbells and barbells. The content of that patent is hereby incorporated by reference.

The advantages of magnetically coupled incremental weights have been offset by a number of deficiencies. First, they have not been usable with non-metallic weight plates, although many dumbbells and bar bells utilize plastic weight plates or plates made of other non-magnetic material. In addition to being less expensive to manufacture, plastic and rubber weight plates are less prone to cause chipping, marring and other surface damage to surrounding gym equipment such as racks and neighboring devices and are less prone to damage inadvertently contacted woodwork and walls. Accordingly, the inability to use magnetically coupled incremental weight plates with increasingly popular non-magnetic dumbbell and barbell weight plates is a severe limitation.

Secondly, there has been a need for strong magnetic attraction between the incremental weight plate and the dumbbell/barbell weight plate to which it is attached. In addition to safety concerns that arise whenever a weight plate can fall from an exercise device, it is undesirable for the incremental weight to shift position during an exercise movement because the resulting imbalance can detract from the safety and efficacy of the exercise movement. The strong magnetic attraction thus required not only makes it difficult to remove the incremental weight plate from the exercise device, but can also scratch or mar the weight plate surface to which the incremental weight attaches, adversely affecting the aesthetics of the device. Moreover, the magnetic micro weights are coupled to coated weight plates on some weight plate devices, and the decoupling effort can scratch or mar the coating, leading to the rusting of the underlying surface.

SUMMARY OF THE INVENTION

A dumbbell and incremental weight plate for same are disclosed herein comprising a bar that extends generally axially between opposing end regions, a weight plate mass mounted about the bar at each end region, means for retaining the mounted weight plate mass at the respective end regions to define a handle region axially inward of the end regions that can be gripped by a user during exercise movement of the dumbbell and at least one incremental weight plate mountable on said weight plate mass. The weight plate mass and incremental weight plate have respective magnetic regions that cause the incremental weight plate to be selectively magnetically secured to the weight plate mass or magnetically repelled from the weight plate mass through the magnetic interaction of respective magnetic regions.

These and further details of the invention will be apparent to those of ordinary skill in the art from reading a description of the preferred embodiment of the invention described below, and of which the drawing forms a part.

DESCRIPTION OF THE DRAWING

FIG. 14 is a rear elevation view in schematic of a cabled exercise device constructed in accordance with a fourth embodiment of the invention.

DESCRIPTION OF THE PREFERRED EMBODIMENT

Figure 1:
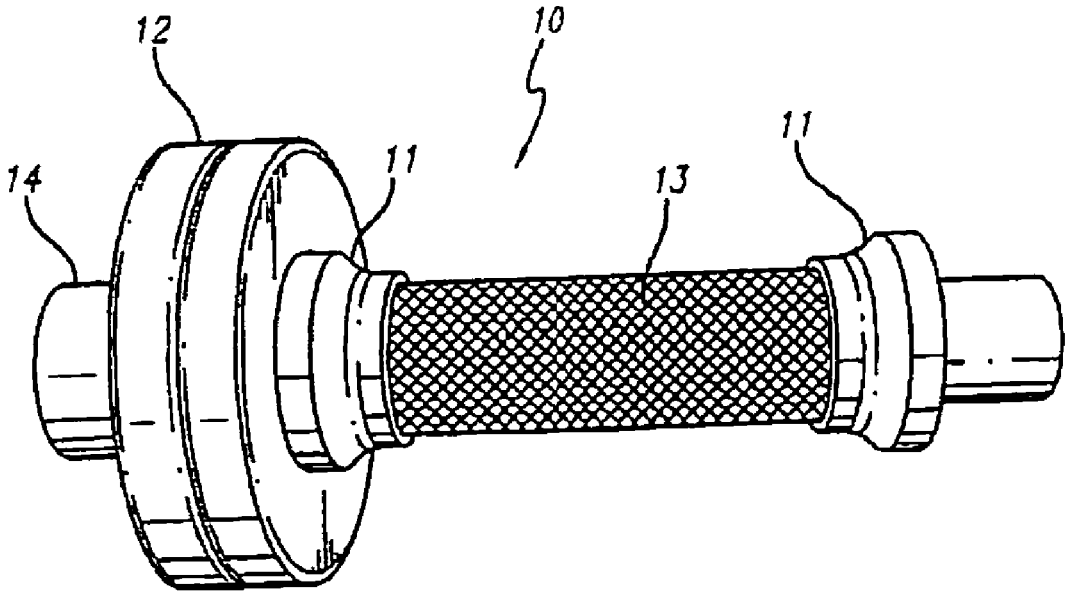
FIG. 1 is a front elevation view showing one end of a dumbbell incorporating the invention herein.
Figure 2:
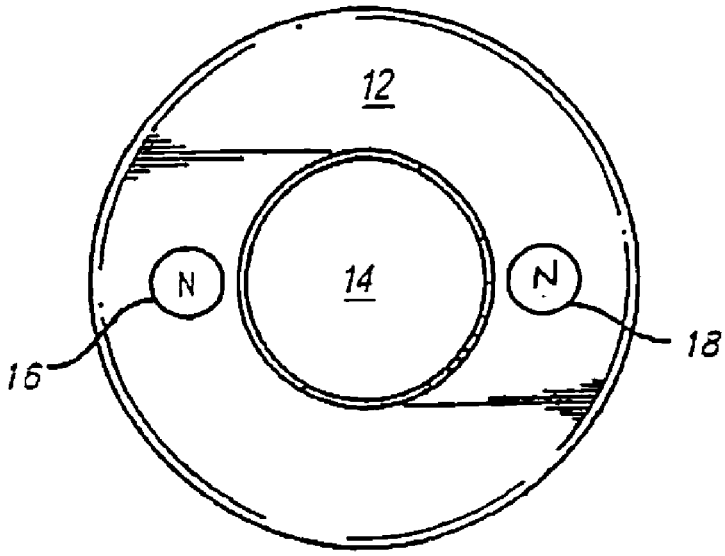
FIG. 2 is a left side elevation view of the dumbbell of FIG. 1.

FIG. 1 is a front elevation view showing one end of a preferred "fixed weight" type dumbbell 10 incorporating constructed in accordance with the invention herein, while FIG. 2 is a left side elevation view of the dumbbell of FIG. 1. Although the invention is discussed in the context of a dumbbell, it should be recognized that bar bells are within the scope of the invention and the term "dumbbell" will be used to denote both devices.

The dumbbell illustrated in FIGS. 1 and 2 has a "base weight" to which an incremental weight of desired poundage is to be added. The base weight of the illustrated dumbbell 10 comprises two generally annular weight plates 12 near the left end of the dumbbell. In practice, base weight is mounted at opposing ends of a longitudinally-extending shaft 14 in the convention conventional manner, but the weight plates near the right end of the illustrated dumbbell are not shown in the FIG. 1. In practice, a plurality of weight plates may be mounted at each end to achieve the desired base weight, or a single weight plate may be utilized. The end portion of the shaft 14 extends through and beyond the outermost weight plate. The weight plates 12 abut respective collars 11 that are located at longitudinally opposed positions on the bar 14 to define a handle region 13 therebetween that is gripped by the user during exercise movements.

Preferably, a pair of magnets 16, 18 are embedded in the outermost weight plate surface at both ends of the dumbbell. The magnets are preferably of the rare earth type, such as neodymium magnets. These are very strong magnets that can be relied upon to securely bind a magnetically-responsive incremental weight plate to the dumbbell. While two magnets 16, 18 are shown in diametrically opposite positions, any other number of magnets (i.e., from one to a plurality) could be used, and other positions could be utilized without departing from the scope of the invention.

As illustrated in FIG. 2, the magnets 16, 18 have their North pole facing outward. As will become clear, both magnets could have their South pole facing outward instead, or each magnet could have a different pole facing outward so long as the desired result is achieved, as described below.

Figure 3:
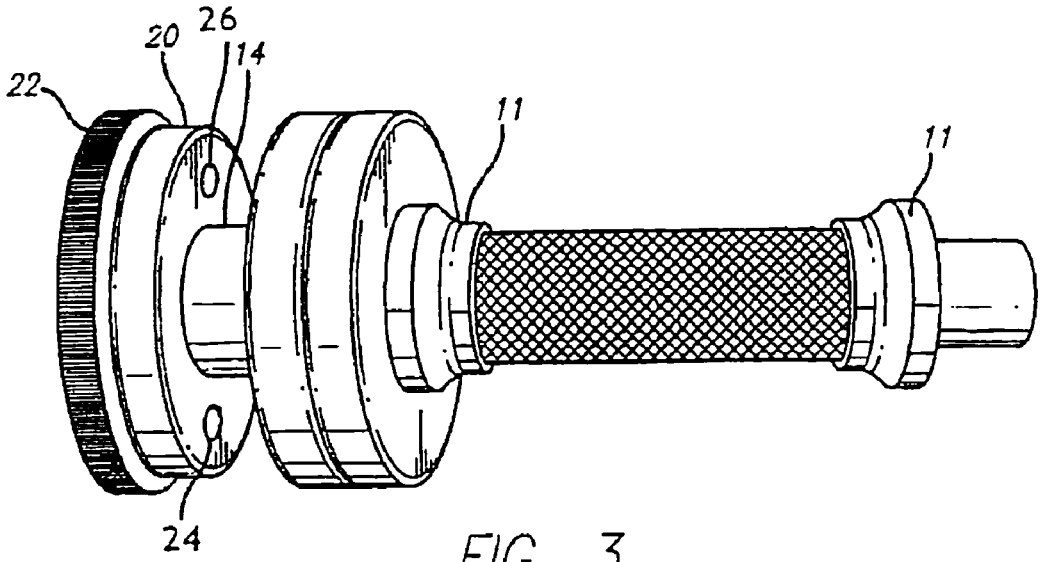
FIG. 3 is a front elevation view of the dumbbell illustrated in FIG. 1 with an added, magnetically responsive weight plate 20 being slid onto its outer shaft 14 in accordance with the invention.
Figure 4:
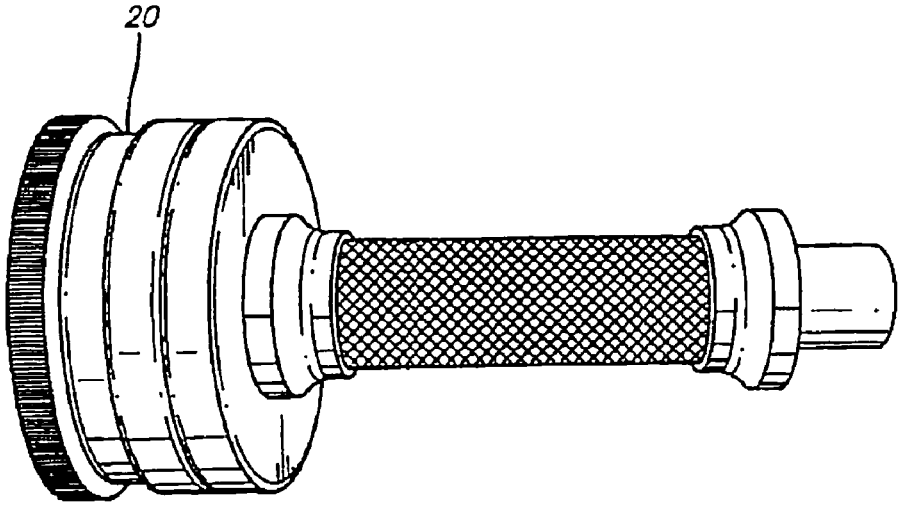
FIG. 4 is a front elevation view of the dumbbell of FIG. 1 with the magnetically-responsive weight plate fully mounted.

FIG. 3 is a front elevation view of the dumbbell of FIG. 1, but showing an outer weight plate 20 of incremental poundage mounted onto the outwardly extending portion of the shaft 14, and FIG. 4 is a front elevation view of the dumbbell of FIG. 1 with the incremental weight plate 20 fully mounted. The weight plate 20 conveniently includes an integrally formed knurled portion 22 of relatively larger diameter that provides a graspable periphery preferably sized to be encompassed by the human hand so that the weight plate 20 can be rotated with one hand in the manner of a jar-top.

The incremental weight plate 20 has one or more magnetic regions whose polarity and positioning result in the incremental weight plate being magnetically secured to the weight plate 12 through the magnetic coupling between their respective magnetic regions when the incremental weight plate is in a securing position on the bar 14, and is magnetically repelled from the dumbbell through the magnetic interaction of respective magnetic regions when the incremental weight plate (and its magnetic region(s)) is rotated about the bar 14 into a decoupling position with respect to the weight plate 12.

Figure 5:
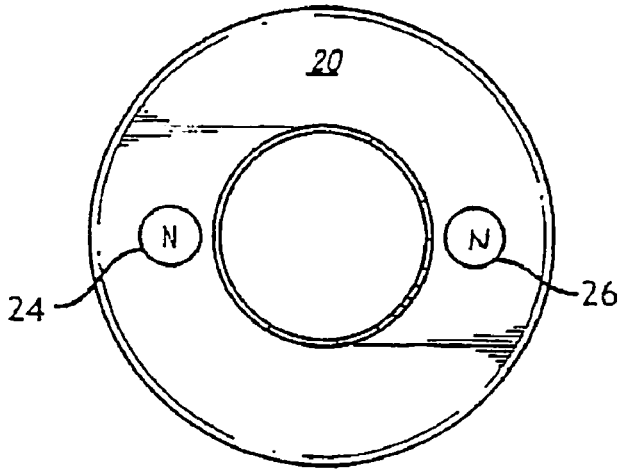
FIG. 5 is a right side elevation view of the magnetically-responsive weight plate shown in FIG. 4.
Figure 6:
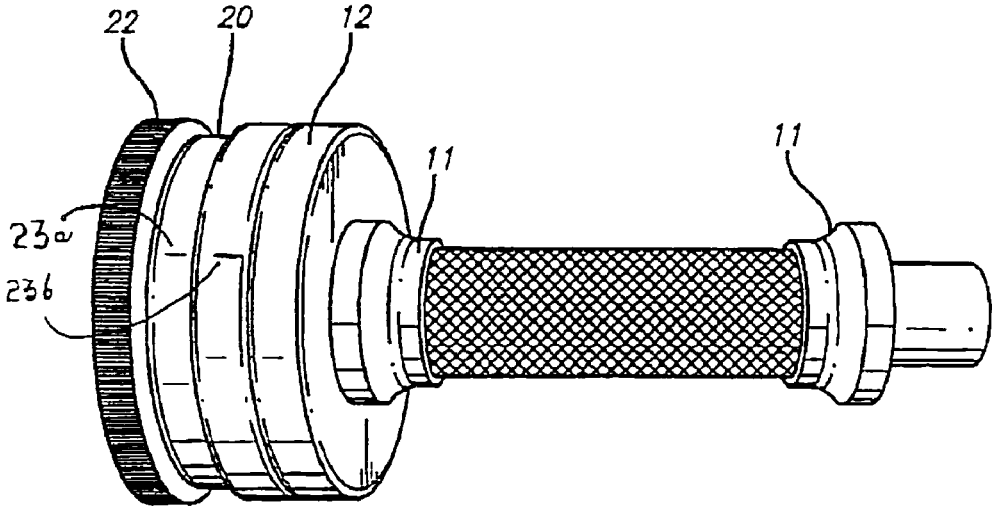
FIG. 6 is a front elevation view of the dumbbell of FIG. 1 with the magnetically-responsive weight plate fully mounted.
Figure 7:
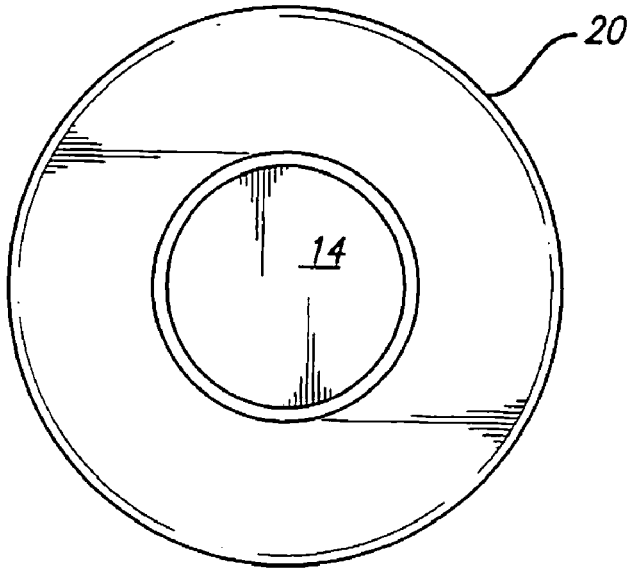
FIG. 7 is a left side elevation view of the dumbbell of FIG. 6.

FIG. 5 is a right side elevation view of the incremental weight plate 20 shown in FIG. 3. The plate 20 is annular, so as to fit concentrically about the shaft 14. The incremental weight is thereby balanced with respect to the shaft, as is preferable for most lifting movements. Naturally, other shaped plates or non-concentric mountings can be provided if an unbalanced arrangement is desired. As further illustrated in FIG. 7, indicia can be stamped, molded or otherwise placed upon the incremental weight plate to display its added incrementally poundage.

As illustrated in FIG. 3 and FIG. 5, the inwardly-facing surface of the incremental weight plate 20—i.e. the surface that faces and engages the weight plate 12—includes a pair of magnets 24, 26 embedded therein and positioned so that they can overlie the magnets 16, 18 when the incremental weight plate is mounted on the shaft 14. The poles are arranged so that the incremental weight plate 20 is magnetically secured to the dumbbell when like-poles of the facing magnets are sufficiently separated by the rotational position of the incremental weight plate on the bar 14 to avoid magnetic repulsion therebetween. Where both the weight plate 12 and the incremental weight plate 20 are formed from a magnetically responsive metal such as iron, those of ordinary skill in the art will recognize that the incremental weight plate can be secured to the dumbbell via the magnet attraction between magnets on one plate and the iron material of the facing plate, so that the decoupling position simply occurs when the incremental weight plate is rotated sufficiently to bring like-poles of facing magnets into interactive repulsion. Similarly, magnetic poles can be arranged on the respective plates (whether or not a plate is itself made from a magnetically responsive material) so that opposite magnet poles attract each other to secure the incremental weight plate to the dumbbell, while repulsive decoupling occurs when the incremental weight plate is rotated sufficiently to bring like-poles of facing magnets into interactive magnetic engagement Accordingly, when the user wishes to decouple the illustrated incremental weight plate from the illustrated dumbbell, the user merely grips the outer knurled periphery of the incremental weight plate with one hand, in the manner by which a jar top is gripped, while the dumbbell is held by the other hand. The incremental weight plate is then rotated about the shaft 14 until the magnets 16 and 24, and magnets in 18 and 22, begin to repel each other, pushing the incremental weight plate 20 away from the weight plate 12. Thus, the user need only apply a relatively easy twisting motion to the incremental weight placed 20 rather then pull the plates apart. The result is that the incremental weight plate seemingly "pops off" the dumbbell. Those of ordinary skill in the art will recognize that a single pair of magnets—e.g., magnets 16 and 24—may be utilized if they provide sufficient attraction to prevent the accidental decoupling the incremental weight plate during exercise movements.

The magnets 24, 26 that have been successfully used are 0.5 inches in diameter and 0.5 inches in length, with a tolerance of 0.005 inches. They are slip-fit into respective bore holes in the incremental weight plate, and the top of the bore walls are center punched radially inward around their peripheries to entrap the magnets within the bores.

To prevent the rotating magnets from marring the surfaces of the weight plate 12 and the incremental weight plates 20, the magnets are preferably recessed from the surfaces of the respective plates by 10 thousandths of an inch or so. Those skilled in the art will recognize that a greater number of magnets could be used, and that they can be positioned differently than those shown in the Figures. Regardless of the number of magnets or their respective positions, the respective poles of the magnets are utilized to attract or repel mating magnets to firmly hold the incremental weight plate on the dumbbell and to assist the user in removing the incremental weight plate, as the case may be. By properly selecting the number of magnets and their relative positions, decoupling with a rotation of less than 180° can be effected.

Figure 8:
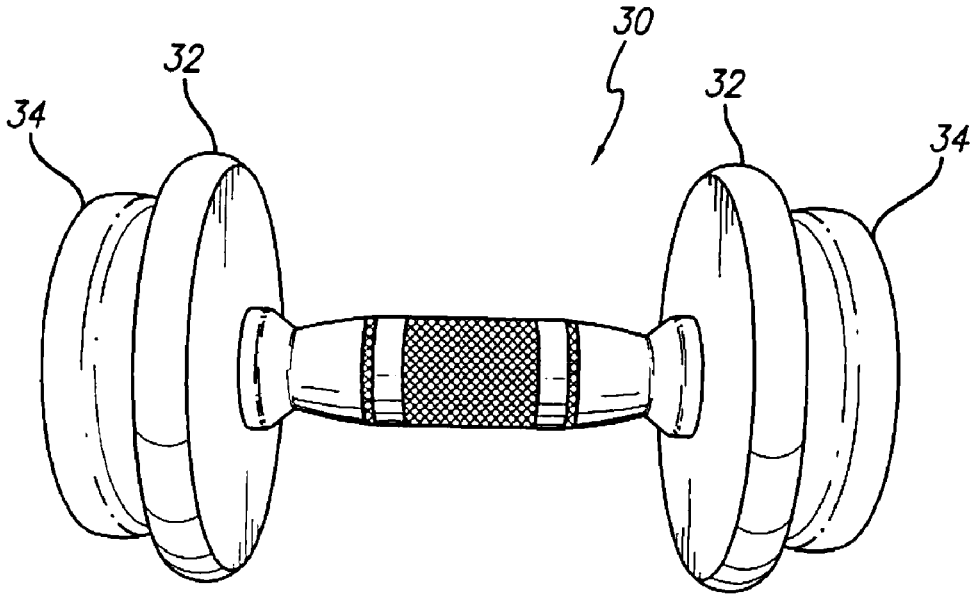
FIG. 8 is a front elevation view of a dumbbell incorporating a second embodiment of the invention.
Figure 9:
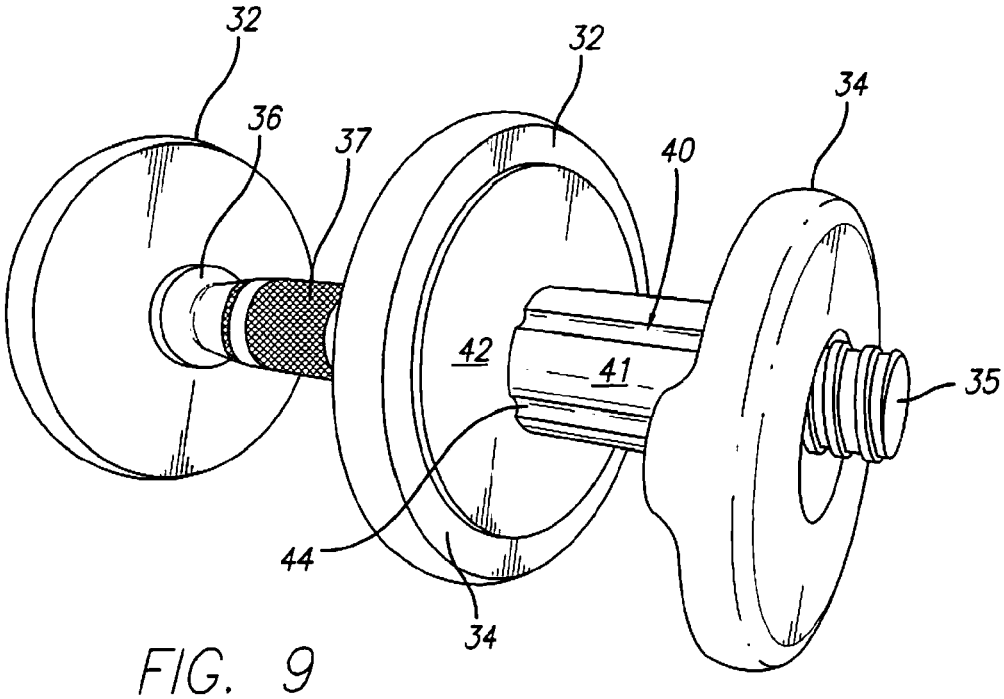
FIG. 9 is a front elevation view of the dumbbell of FIG. 8, showing the magnetically-responsive weight plate positioned for mounting onto the dumbbell in accordance with the invention.
Figure 10:
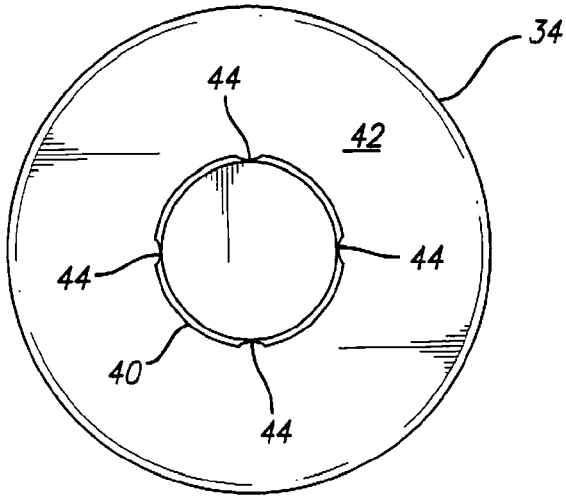
FIG. 10 is a right side elevation view of the sleeve 40 of FIG. 8.

A second embodiment of the invention is shown in FIGS. 8-11. FIG. 8 is a front elevation view of a dumbbell of the "adjustable" type, wherein weight plates are secured on the bar by removable collars that permit the user to add or remove individual weight plates to the dumbbell. FIG. 9 is a left side elevation view of the dumbbell of FIG. 8, and FIG. 10 is a front elevation view of the dumbbell of FIG. 8, showing the incremental weight plate 34 positioned for mounting onto the dumbbell in accordance with the invention.

In this embodiment, outer weight plates 32 and incremental weight plates 34 are mounted on opposite ends of a shaft 35 that extends through the dumbbell handle 37. As will become clear, the outer weight plates 32 need not be magnetically responsive but can, instead, be made of polyurethane or other commonly utilized plastic material such as that found in less expensive dumbbell sets.

Figure 11:
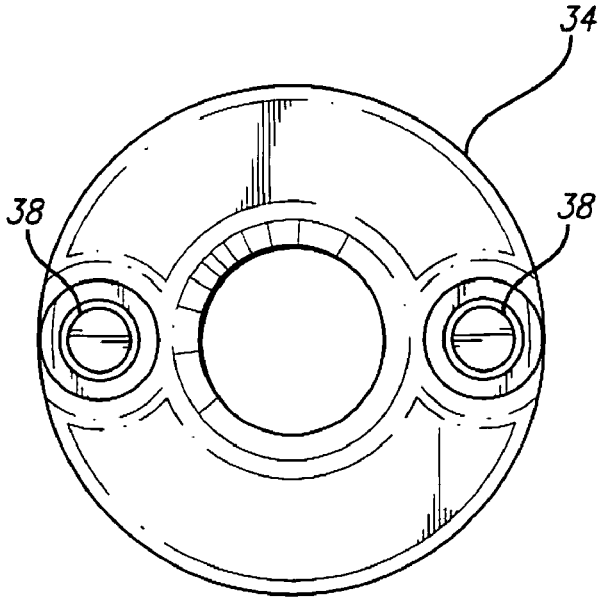
FIG. 11 is a left side elevation view of the right magnetically-responsive weight plate 34 illustrated in FIG. 9.

FIG. 11 is a left side elevation view of the right incremental weight plate 34 of FIG. 8, showing two magnets 38.

The shaft 35 is of the known externally-threaded variety. Conventionally, weight plates are mounted on to the shaft and urged toward the dumbbell's handle until stopped by the collar 36 or a previously mounted way to plate. An internally threaded nut or other such fastening device is then rotated onto the shaft until securing contact is made with the way to plate.

In accordance with the invention, a sleeve 40 is mounted on to the shaft 35. The sleeve preferably has a "T"-shaped cross-section, comprising an internally-threaded cylindrical portion 41 that is tightened onto the threaded shaft 35, and a leading base portion 42 of relatively greater diameter that butts up against the outer plate 32. The base portion 32 is formed from magnetically responsive material. Alternatively, the base portion 32 can include magnets for the coupling/decoupling effect previously described. In either case, the base portion 42 provides a magnetically responsive seat for the incremental weight plate 34 regardless of whether the outer plate 32 is made of magnetically-responsive material or not. Further, the base portion 42 provides a wear surface that prevents the outer plate 32 from being marred or damaged by the incremental plate 34, particularly when the outer plate 32 is plated or coated with an aesthetically pleasing layer of material.

The sleeve 40 may be tightened onto the shaft 35 by mounting the sleeve and magnetically coupled incremental weight plate 34 together as a unit, and utilizing the incremental plate 34 as a handle in a jar-lid tightening manner. To enable the sleeve 40 to be more firmly tightened onto the shaft, however, a series of longitudinally-extending grooves 44 are preferably formed in the cylindrical portion 41 of the sleeve, as best shown in FIG. 10, for gripping by complimentary surfaces of a tightening tool. FIG. 10 is a right side elevation view of the sleeve 40.

Figure 12:
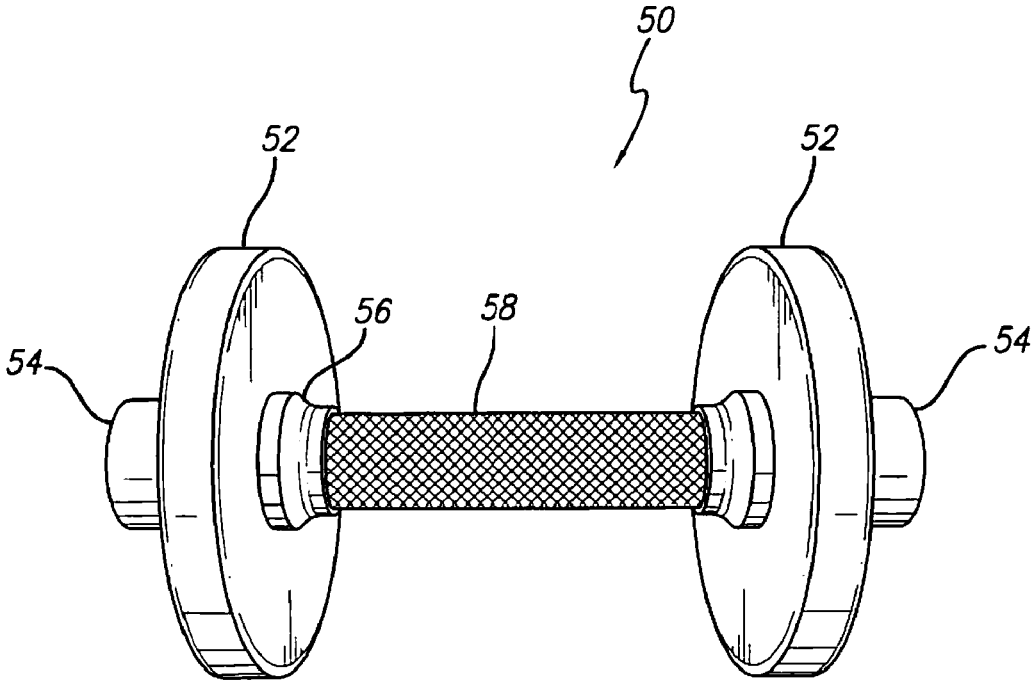
FIG. 12 is a front elevation view of a dumbbell constructed in accordance with a third embodiment of the invention.
Figure 13:
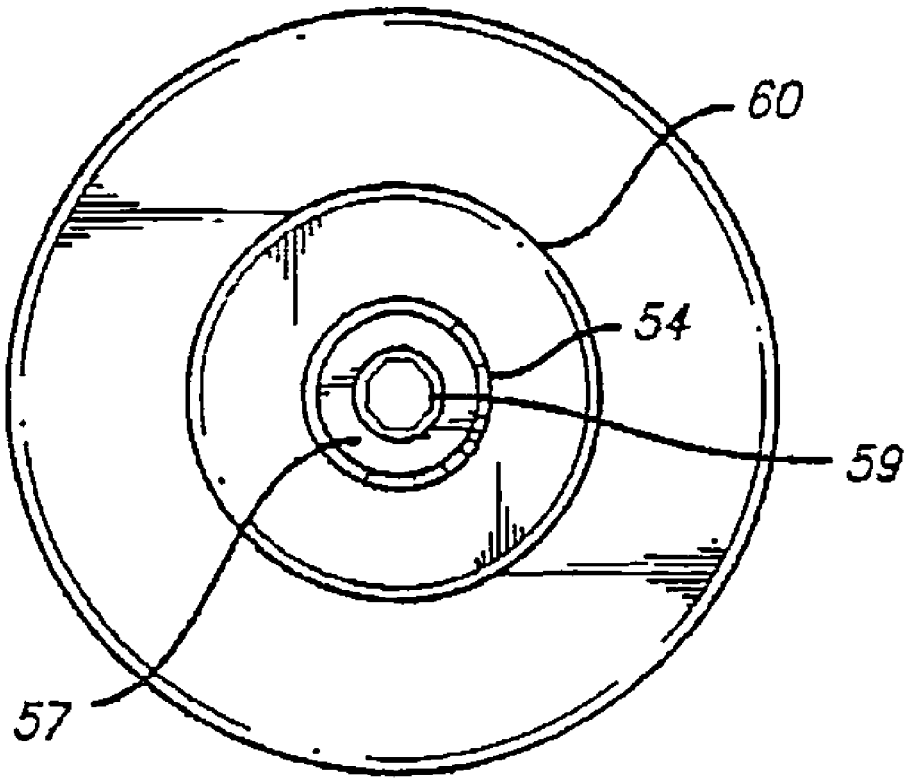
FIG. 13 is a left side elevation view of the dumbbell of FIG. 12.
Figure 4:
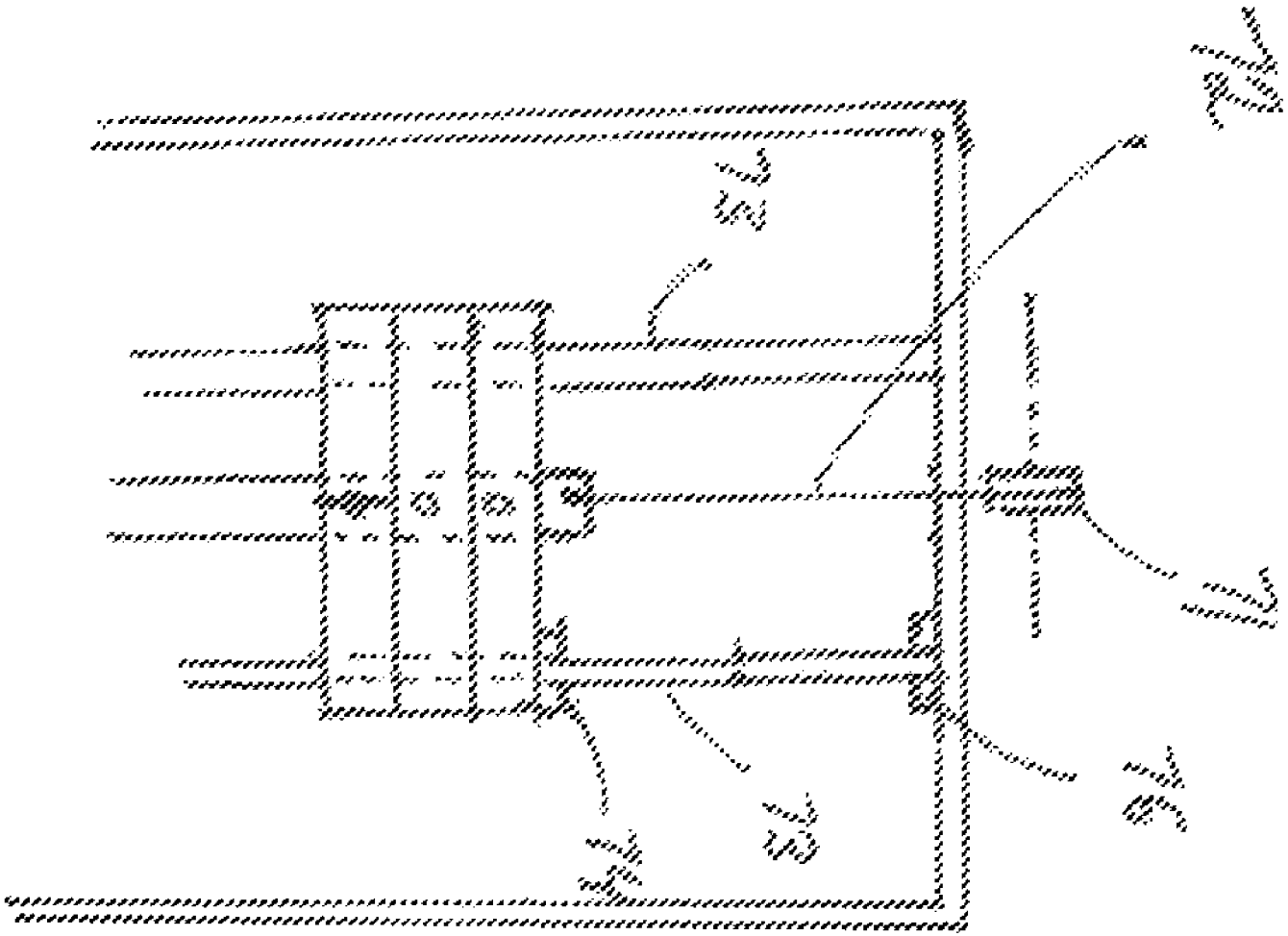

FIG. 12 illustrates a third embodiment of the invention. FIG. 12 is a front elevation view of a dumbbell of the "fixed weight" type, wherein weight plates 52 are permanently secured on the ends of a shaft that extends through the dumbbell handle 58. FIG. 13 is a side elevation view of the dumbbell of FIG. 12. Again, the weight plates 52 may be magnetically responsive or not. An annular, longitudinally-extending cylindrical sleeve 54 having a relatively larger diameter base portion 60 is affixed to the dumbbell at each end of the dumbbell via a respective hex bolt 59 that is inserted through the sleeve and threaded into an internally threaded end region of the shaft to secure the sleeve 54 and weight plate 52 against the collar 56 formed at each end of the handle 58. Incremental weight plates can then be added and removed as described above, preferably but not necessarily utilizing magnets in the base portion 60 to repel the incremental weight plate when the incremental weight plate is rotated to bring its magnets into general alignment with pole(s) of opposing magnet(s) in the base portion.

The invention herein is not limited to dumbbells or barbells. It can, for example be applied to cable-type exercise equipment. FIG. 14 is a rear elevation view in schematic of a cabled exercise device constructed in accordance with a fourth embodiment of the invention. An adjustable stack of weight plates 70 is lifted by a user who is pulling them upward by a cable 72 via a pulley 71 or other means known in the art. The stack of weight plates is guided by guide rods 73, which guide the stack's movement vertically, and keep the plates evenly stacked as they move. "Sleeves" with magnetically-responsive base portions may be affixed, as at 74, to the topmost weight plate to accommodate incremental weight plates, thereby offering a total poundage that falls between the increments of weight offered by the stack. The base portions of the "sleeves" may include magnets, as described above, to repel the incremental weight plate when the incremental weight plate is appropriately rotated, or the sleeve. The "sleeves" need not be annular in this application, and the term "sleeve" has been used only for consistency of terminology with respect to embodiments described above.

Alternatively, the "sleeves" of this embodiment can be positioned as at 76, with the incremental weight plates being held magnetically above the stack until needed, and then being selectively decoupled from the "respective" sleeve and guided vertically about the respective guide rod 73 from the "sleeve" to the weight plate stack. Once again, the decoupling, action can be purely manual, or the "sleeves" can include magnets in their base portions to repel the incremental weight plate when the incremental weight plate is suitable rotated, as described earlier.

Although the present invention and its advantages have been described in detail, it should be understood that various changes, substitutions and alterations can be made herein without departing from the spirit and scope of the invention as will be defined by appended claims.

I claim:

1. A dumbbell comprising:

a bar that extends generally axially between opposing end regions, a weight plate mass permanently secured to the dumbbell about the bar at each end region, the axially outermost surface of each weight plate mass having at least one magnetic region having a magnetic pole facing axially outward; and means for retaining the mounted weight plate mass at the respective end regions to define a handle region axially inward of the end regions that can be gripped by a user during exercise movement of the dumbbell.

2. The dumbbell of claim 1 further including an incremental weight plate sized to be mounted on the axially outermost surface of the weigh plate mass, the incremental weight plate having at least one magnetic region positioned to face axially inward when the incremental weight plate is mounted on the dumbbell so that the incremental weight plate is magnetically repelled from the weight plate mass when at least a portion of the at least one magnetic region of the incremental weight plate generally overlies at least a portion of the at least one magnetic region of the weight plate mass.

3. The dumbbell of claim 1 further including an incremental weight plate mounted for rotation about the bar at least one end region and having an axially inwardly-facing magnetic pole positioned to selectively couple magnetically to the at least one magnetic region of the weight plate mass when the incremental weight plate is rotated about the bar into a removal position to thereby magnetically repel the incremental weight plate from the weight plate mass.

4. The dumbbell of claim 1 wherein the bar extends axially outward of the weight plate mass at each end region sufficiently to accept a generally annular incremental weight plate having a generally central through hole that accommodates the bar.

5. The dumbbell of claim 1 wherein the weight plate mass at each end region has a pair of magnetic regions positioned generally diametrically opposite about the bar.

6. The dumbbell of claim 5 further including a generally annular incremental weight plate having a generally central bar-accommodating through-hole and sized to be mounted on the axially outermost surface of the weight plate mass, the incremental weight plate having a pair of magnetic regions positioned to be at diametrically opposite side of the bar and to face axially inward when the incremental weight plate is mounted on the dumbbell.

7. A dumbbell comprising:

a bar that extends generally axially between opposing end regions, a weight plate mass mounted about the bar at each end region, means for retaining the mounted weight plate mass at the respective end regions to define a handle region axially inward of the end regions that can be gripped by a user during exercise movement of the dumbbell, and at least one incremental weight plate mountable on said weight plate mass, the weight plate mass and the incremental weight plate having respective magnetic regions that cause the incremental weight plate to be magnetically secured to the weight plate mass when the incremental weight plate is not in a decoupling position, and that cause like magnetic poles associated with the weight plate mass and the incremental weight plate to repel the incremental weight plate from the weight plate mass when the incremental weight plate is rotated about the bar into the decoupling position.

* * * * *